US010070684B2

(12) United States Patent
Orcutt

(10) Patent No.: US 10,070,684 B2
(45) Date of Patent: Sep. 11, 2018

(54) TOE TETHERS FOR USE WITH SANDALS AND SANDALS WITH INTEGRATED TOE TETHERS

(71) Applicant: Alexander Orcutt, Austin, MN (US)

(72) Inventor: Alexander Orcutt, Austin, MN (US)

( * ) Notice: Subject to any disclaimer, the term of this patent is extended or adjusted under 35 U.S.C. 154(b) by 0 days.

(21) Appl. No.: 14/262,331

(22) Filed: Apr. 25, 2014

(65) Prior Publication Data

US 2014/0317965 A1 Oct. 30, 2014

Related U.S. Application Data

(60) Provisional application No. 61/815,819, filed on Apr. 25, 2013.

(51) Int. Cl.

| | |
|---|---|
| ***A43B 3/10*** | (2006.01) |
| ***A43B 3/18*** | (2006.01) |
| ***A43B 3/12*** | (2006.01) |
| ***A43B 23/00*** | (2006.01) |

(52) U.S. Cl.

CPC ..... *A43B 3/105* (2013.01); *A43B 3/10* (2013.01); *A43B 3/103* (2013.01); *A43B 3/12* (2013.01)

(58) Field of Classification Search

CPC .. A43B 3/10; A43B 3/103; A43B 3/12; A43B 3/105

USPC ..... 36/7.5, 7.7, 11.5, 136

See application file for complete search history.

(56) References Cited

U.S. PATENT DOCUMENTS

| | | | | | |
|---|---|---|---|---|---|
| 1,098,397 | A * | 6/1914 | Pecorella | A61F 5/019 | 128/893 |
| 1,167,019 | A * | 1/1916 | Reed | A61F 5/019 | 36/11.5 |
| 1,867,679 | A * | 7/1932 | Riehle | A43B 7/26 | 36/11.5 |
| 2,575,868 | A | 11/1951 | Ferri | | |
| 2,751,693 | A * | 6/1956 | Baker | A43B 7/26 | 132/73 |
| 2,818,061 | A | 12/1957 | Birch | | |
| 3,121,962 | A * | 2/1964 | Gullo | A43B 3/128 | 36/11.5 |
| 3,275,002 | A | 9/1966 | Scholl | | |
| 3,780,690 | A * | 12/1973 | McGahee | B63B 21/04 | 114/218 |
| 4,300,294 | A | 11/1981 | Riecken | | |
| 4,745,927 | A | 5/1988 | Brock | | |
| 4,813,162 | A * | 3/1989 | Harris | A43B 3/108 | 36/11.5 |
| 6,151,801 | A * | 11/2000 | Frederiksen | A43B 3/105 | 36/11.5 |
| 6,226,893 | B1 * | 5/2001 | Schlamp | A43B 3/102 | 36/11.5 |
| D456,123 | S * | 4/2002 | Powell | D2/917 | |

(Continued)

*Primary Examiner* — Clinton T Ostrup
*Assistant Examiner* — Cameron A Carter
(74) *Attorney, Agent, or Firm* — Patterson Thuente Pedersen, P.A.

(57) ABSTRACT

Toe tethers for use with sandals and sandals with one or more integrated toe tethers are disclosed. A toe tether can include a toe retention region constructed to engage a toe of the human foot, an extension region integrated with the toe retention region, and a self anchoring region integrated with the extension region. In one embodiment, a toe tether may be secured to or integrated with a retention strap of a sandal. In another embodiment, a toe tether may be secured to a platform of a sandal.

18 Claims, 6 Drawing Sheets

(56) References Cited

U.S. PATENT DOCUMENTS 6,625,904 B1 * 9/2003 Frederiksen ..... A43B 3/105 36/11.5
D487,183 S * 3/2004 Cumeau ..... D2/917
D489,517 S * 5/2004 Comeau ..... D2/917
D513,447 S * 1/2006 Corneau ..... D2/917
7,439,837 B2 10/2008 McDonald
RE42,483 E * 6/2011 Comeau ..... D2/917
8,413,349 B2 * 4/2013 Krauss ..... A43B 7/26 36/11.5
2003/0029056 A1 * 2/2003 Frederiksen ..... A43B 3/105 36/11.5
2008/0060230 A1 * 3/2008 Kernkamp ..... A43B 3/122 36/70 R
2009/0113759 A1 * 5/2009 Heid ..... A43B 1/0081 36/92
2010/0000127 A1 * 1/2010 Feller ..... A43B 1/0081 36/101
2010/0251569 A1 * 10/2010 Stern ..... A43B 3/103 36/94
2011/0179674 A1 * 7/2011 Heid ..... A43B 1/0081 36/91
2011/0314691 A1 * 12/2011 Krauss ..... A43B 3/105 36/11.5
2012/0152267 A1 * 6/2012 Chang ..... A43B 3/103 132/200
2012/0183168 A1 * 7/2012 Humes ..... A43B 3/0005 381/334
2012/0204441 A1 * 8/2012 Conner ..... A43B 3/103 36/11.5
2013/0269213 A1 * 10/2013 Gift ..... A43B 7/26 36/101
2014/0259772 A1 * 9/2014 Hazarian ..... A43B 3/105 36/94

* cited by examiner

500

TOE TETHERS FOR USE WITH SANDALS AND SANDALS WITH INTEGRATED TOE TETHERS

CROSS-REFERENCE TO RELATED APPLICATIONS

This application claims the benefit of U.S. Provisional Application No. 61/815,819, filed Apr. 25, 2013, the disclosure of which is incorporated by reference.

TECHNICAL FIELD

The present invention relates generally to footwear, and more particularly to toe tethers for use with sandals and footwear having toe tethers.

BACKGROUND OF THE INVENTION

Thong sandals are one of the most popular types of sandals purchased by consumers. Generally, these types of sandals include a retention strap with a post or thong that fits between the first and second toes of a wearer. Thong sandals may be preferred over other types of sandals for their simple design, ease of use, and comfort. During some activities, however, the security of a typical thong sandal may be inadequate. For example, running or bicycling may cause a thong sandal to slip from the foot of a wearer and the wearer may be injured as a result. As another example, upon entering a body of water, a thong sandal may become dislodged and easily lost. Thus, there is a need for improved retention of thong sandals.

SUMMARY OF THE INVENTION

Toe tethers for use with sandals and sandals with integrated toe tethers are disclosed. A toe tether can include a toe retention region constructed to engage a toe of the human foot, an extension region integrated with the toe retention region, and a self anchoring region integrated with the extension region. In one embodiment, a toe tether may be secured to or integrated with a retention strap of a sandal. In another embodiment, a toe tether may be secured to a platform of a sandal.

In one embodiment, the present invention comprises a toe tether for use with a sandal having a platform and a retention strap that is secured to three locations on the platform, the retention strap including a post region operative to fit between two toes of a human foot, wherein the post region is secured to one of the three locations, the toe tether comprising a toe retention region constructed to engage a toe of the human foot, an extension region integrated with the toe retention region, and a self anchoring region integrated with the extension region, wherein the toe retention region and the extension region are operative to wrap around a portion of the retention strap and pass through the self anchoring region so that the toe tether is secured to the portion of the strap, and wherein the extension region has a length sufficient to enable the toe retention region to engage the toe.

In one embodiment, the present invention comprises a sandal comprising a platform, a retention strap that is secured to three locations on the platform, the retention strap including a post region operative to fit between two toes of a human foot, wherein the post region is secured to one of the three locations, and a toe tether configured to engage a toe.

In one embodiment, the present invention comprises a method, comprising providing a sandal, including a platform and a retention strap that is secured to three locations on the platform, the retention strap including a post region operative to fit between two toes of a human foot, wherein the post region is secured to one of the three locations, providing a toe tether for use with the sandal, the toe tether including a toe retention region constructed to engage a toe of the human foot, an extension region integrated with the toe retention region and having a length sufficient to enable the toe retention region to engage the toe, and a self anchoring region integrated with the extension region, and providing instructions recorded on a tangible medium. The instructions comprise wrapping the toe retention region and the extension region around a portion of the retention strap of the sandal, passing the toe retention region and the extension region through the self anchoring region so that the toe tether is secured to the portion of the retention strap, and engaging the toe with the toe retention region of the toe tether.

In one embodiment, the present invention comprises a sandal comprising a platform having a toe region and a heel region, at least two toe tethers integrated with the platform in the toe region, each of the toe tethers configured to engage a toe of a foot of a wearer, and a strap integrated with the platform in the heel region and configured to retain a heel of the wearer, wherein the sandal lacks a retention strap to retain a midfoot of the wearer.

A further understanding of the nature and advantages of the embodiments discussed herein may be realized by reference to the remaining portions of the specification and the drawings.

BRIEF DESCRIPTION OF THE DRAWINGS

The invention may be more completely understood in consideration of the following detailed description of various embodiments of the invention in connection with the accompanying drawings, in which.

Figure 1A:
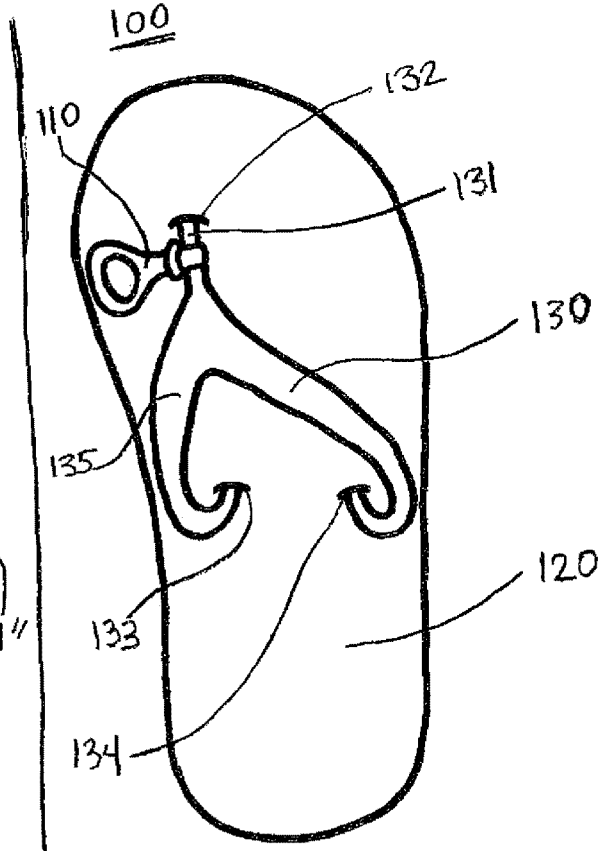
FIG. 1A is a top plan view of a sandal including a toe tether secured to a retention strap of the sandal in accordance with an embodiment.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE INVENTION

The following detailed description should be read with reference to the drawings in which similar elements in different drawings are numbered the same. The drawings, which are not necessarily to scale, depict illustrative embodiments and those of ordinary skill in the art will realize that these various embodiments are not intended to limit the scope of the invention. In the following detailed description, for purposes of explanation, numerous specific details are set forth to provide a thorough understanding of the various embodiments of the present invention. Other embodiments of the present invention will readily suggest themselves to such skilled persons having the benefit of this disclosure.

In addition, for clarity purposes, not all of the routine features of the embodiments described herein are shown or described. One of ordinary skill in the art would readily appreciate that in the development of any such actual embodiment, numerous embodiment-specific decisions may be required to achieve specific design objectives. These design objectives will vary from one embodiment to another and from one developer to another. Moreover, it will be appreciated that such a development effort might be complex and time-consuming but would nevertheless be a routine engineering undertaking for those of ordinary skill in the art having the benefit of this disclosure.

FIG. 1A depicts sandal 100 including toe tether 110 in accordance with an embodiment. As depicted, sandal 100 may also include platform 120 and retention strap 130. Retention strap 130 may be fixed to platform 120 at attachment points 132, 133, and 134 by any suitable means (e.g., via adhesive or an interference fit). Retention strap 130 may include post 131 that fits between two toes of a foot of a wearer, and broad portion 135 that engages a top portion of the foot of the wearer. Toe tether 110 may be secured to a suitable portion of retention strap 130. For example, as depicted in FIG. 1A, toe tether 110 may be attached to post 131. Although toe tether 110 is depicted attached to post 131, it is understood that tether 110 can be attached to any portion of retention strap 130.

Figure 1B:
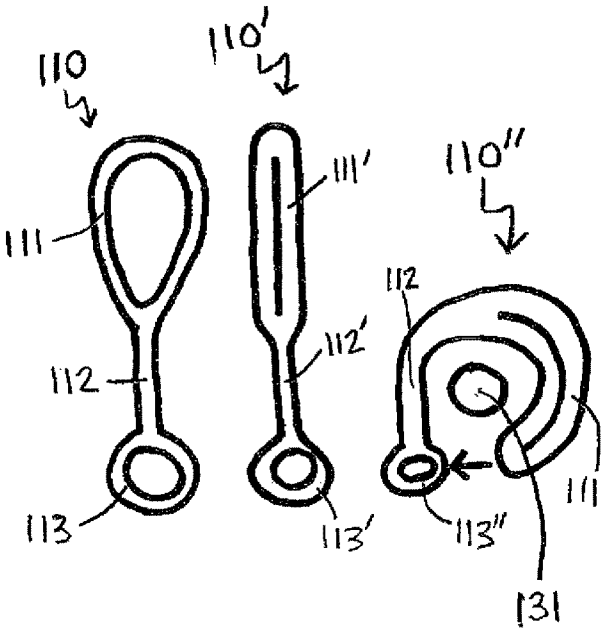
FIG. 1B is a series of top plan views of the toe tether of FIG. 1A in various states, demonstrating how a wearer would secure the toe tether to the retention strap of FIG. 1A in accordance with an embodiment.

Referring now to FIG. 1B, toe tether 110 may include toe retention region 111, extension region 112, and self-anchoring region 113. Toe retention region 111 may be configured to engage a toe of a human foot. For example, toe retention region 111 may fit over the end of the toe and slide to the base of the toe in a manner similar to how a ring fits on a finger. Generally, toe retention region Ill may be sized for a first or "big" toe, but it is understood that region 111 can be sized to fit any toe. Toe retention region 111 may be made of a material that can be formed into a desired shape. The material may be durable so toe retention region 111 can withstand many uses without fatigue or breakage. Additionally, in some embodiments, the material may be elastic so region 111 can stretch over a larger part of the toe and then return to its original, relaxed state at the base of the toe. As an example, toe retention region 111 may be made of a rubber such as Neoprene. In other embodiments, the material may not be elastic (e.g., toe retention region 111 may be made of cloth). One skilled in the art will appreciate that there are several possible compositions for toe retention region 111.

Extension region 112 may extend from toe retention region 111 and join region 111 to self-anchoring region 113. As mentioned regarding region 111, extension region 112 may also be made of a durable and/or elastic material. Accordingly, extension region 112 may stretch to allow toe retention region 111 to be properly positioned. When tether 110 is not in use, extension region 112 may return to its original shape. In some embodiments, extension region 112 may be made from the same material as toe retention region 111. In other embodiments, region 112 may be made from a different material as region 111.

Self-anchoring region 113 may be located at an opposite end of toe tether 110 as toe retention region 111. Self-anchoring region 113 may include an aperture that allows region 111 and at least a portion of region 112 to pass through it. As explained below, the aperture may allow tether 110 to wrap around and secure to a portion of retention strap 130. Self-anchoring region 113 may be durable, however, region 113 may not necessarily be elastic. In some embodiments, region 113 may be made from the same material as toe retention region 111 and/or extension region 112. In other embodiments, region 113 may be made from a different material as regions 111 and 112.

As depicted in FIG. 1B, toe tether 110 may be manipulated through several states (e.g., 110, 110', and 110") in order to achieve the configuration depicted in FIG. 1A. First, toe retention region 111 can be flattened as depicted by region 111'. Next, toe retention region 111' and extension region 112' can be bent around post 131 of retention strap 130. Finally, region 111" and a portion of region 112" can be inserted through self-anchoring region 113". The resulting configuration allows toe tether 110 to be secured to post 131 and itself.

Figures 2, 3:
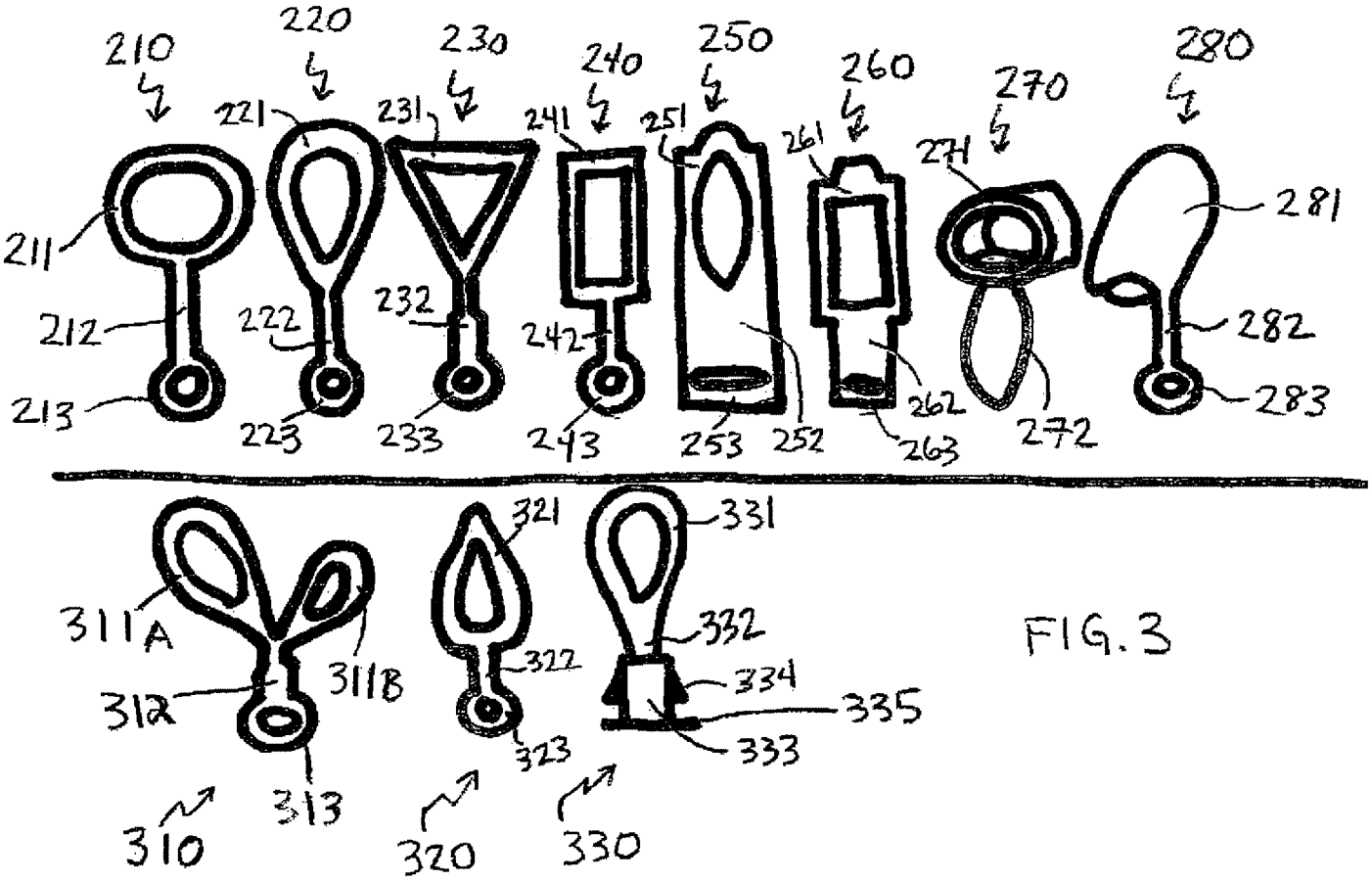
FIG. 2 is a top plan views of several alternative toe tethers in accordance with various embodiments.
FIG. 3 is a top plan views of additional alternative toe tethers in accordance with various embodiments.

Turning now to FIG. 2, alternative embodiments of toe tethers 210, 220, 230, 240, 250, 260, 270, and 280 are depicted. It is understood that each of the toe tethers may share one or more of the characteristics described with respect to toe tether 110 of FIGS. 1A and 1B. In some embodiments, the toe retention region may be round or oblong (e.g., toe retention regions 211 or 221). In other embodiments, the toe retention region may have a different shape such as a triangle or a rectangle to achieve a desired aesthetic (e.g., toe retention regions 231 or 241). In some embodiments, the extension region may be widened (e.g., extension regions 252 and 262) so that a toe tether is better suited to wrap around a broader portion of a retention strap on a sandal.

In some embodiments, the extension region and self-anchoring region may be combined. For example, toe tether 270 may include extension region 272 shaped as a thin cord. In this embodiment, region 272 may define an aperture that would otherwise be defined by a self-anchoring region. Toe retention region 271 may be made of a wider band of material in order to provide additional comfort when fitted around a toe of a wearer. In this embodiment, region 271 and a portion of region 272 may wrap around a portion of a sandal and pass through the aperture defined by region 272 in order to secure tether 270 to the sandal. In other embodiments, the toe retention region may fully encapsulate a top portion of the toe of the wearer. For example, toe retention region 281 may fully surround the toe of the wearer, and fit snugly around the toe similar to a hat on a head.

Referring now to FIG. 3, additional alternative embodiments of toe tethers 310, 320, and 330 are depicted. It is understood that each of the toe tethers may share one or more of the characteristics described with respect to toe tether 110 of FIGS. 1A and 1B. In some embodiments, a toe tether may include multiple toe retention regions. For example, toe tether 310 includes toe retention regions 311A and 311B. Toe retention region 311A may engage a first toe of the wearer while region 311B may engage a second toe of the wearer. While only two toe retention regions are depicted, it is understood that tether 310 may include a toe retention region that engages each toe on the foot of the wearer.

In some embodiments, a toe tether may include a self-anchoring region with an alternative design. In these embodiments, the toe tether may be secured to a platform of a sandal instead of to a retention strap of the sandal. For example, toe tether 330 includes self-anchoring region 333. Self-anchoring region 333 may include wedge-shaped barbs 334 and lip 335. In order to secure tether 330 to the platform, the wearer may be required to form a hole in the platform (e.g., using a drill). Toe retention region 331 and extension region 332 may then be passed from a bottom side of the platform through the hole to a top side of the platform. Barbs 334 may also pass through the hole. In the final configuration, barbs 334 may rest against the top side of the platform while lip 335 may rest against the bottom side of the platform. The hole may be sized to correspond to a narrowest diameter of self-anchoring region 333 in order to provide a tight fit with the platform. Additionally, the spacing between barbs 334 and lip 335 may be configured based on the thickness of the platform. After tether 330 is secured to the platform, the final configuration may resemble toe tether 610 and platform 620 of FIG. 6A.

Figure 4:
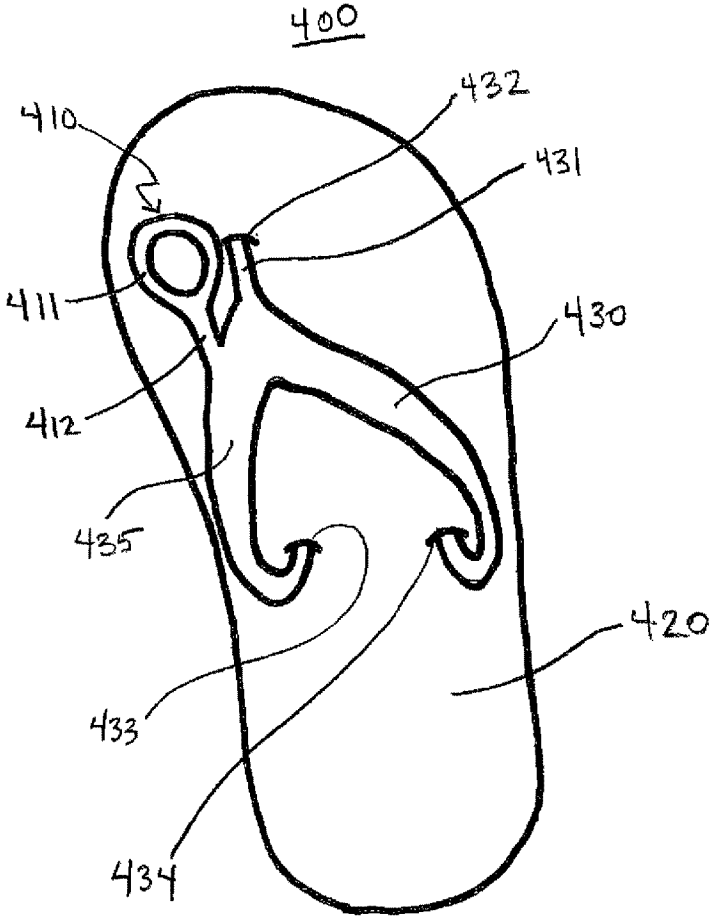
FIG. 4 is a top plan view of a sandal including a toe tether directly integrated into a retention strap of the sandal in accordance with an embodiment.

In certain embodiments, a toe tether can be directly integrated with a sandal. Referring now to FIG. 4, a sandal including a toe tether directly integrated into a retention strap of the sandal is depicted. Sandal 400 may include platform 420 and retention strap 430. Retention strap 430 may be secured to platform 420 at attachment points 432, 433, and 434. Retention strap 430 may include broad portion 435 and post 431. As depicted, toe tether 410 may be directly integrated with broad portion 435 of strap 430. For example, retention strap 430 may be made from plastic or rubber and toe tether 410 may be molded into strap 430 as part of the same process used to form strap 430. Tether 410 may be molded in a location that allows extension region 412 to extend over a toe of the wearer such that toe retention region 411 may properly engage the toe. It is understood that tether 410 may share one or more of the characteristics as described with respect to toe tether 110 of FIGS. 1A and 1B. In some embodiments, retention strap 430 may be made of an alternative material such as leather or cloth. In these embodiments, extension region 412 of tether 410 may be sewn to retention strap 430 instead of being molded with strap 430.

Figure 5:
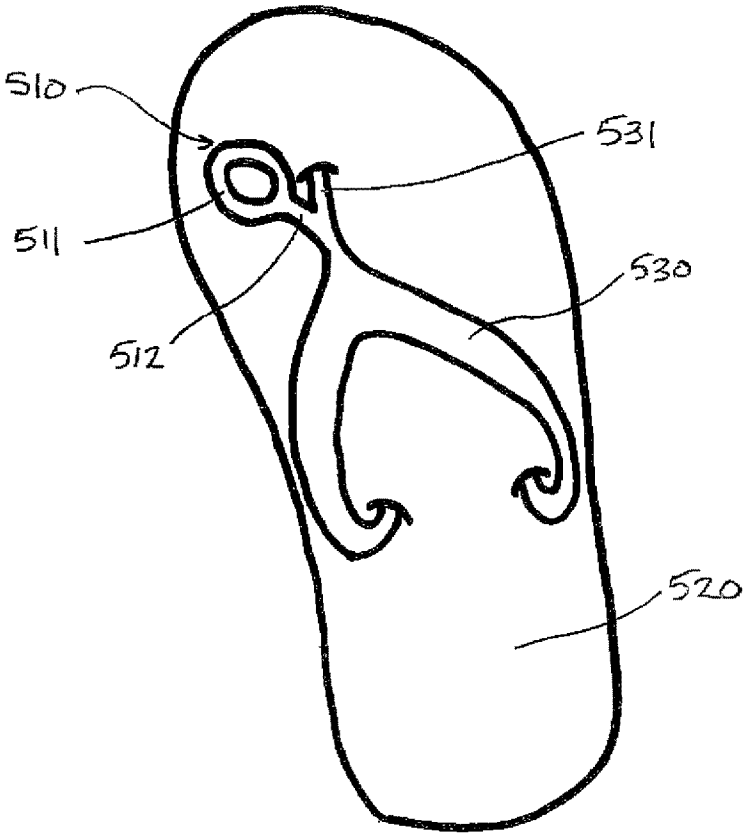
FIG. 5 is a top plan view of a sandal including a toe tether directly integrated into an alternative location of a retention strap of the sandal in accordance with an embodiment.

One skilled in the art will appreciate that there are many potentially suitable locations along a retention strap of a sandal where a toe tether may be integrated. Turning now to FIG. 5, a sandal including a toe tether directly integrated into an alternative location of a retention strap of the sandal is depicted. Sandal 500 may include platform 520 and retention strap 530. As depicted, toe tether 510 may be directly integrated with post 431 of strap 430. It is understood that tether 510 and strap 530 may share similar characteristics as described with respect to tether 410 and strap 430 of FIG. 4.

Figures 6A, 6B:
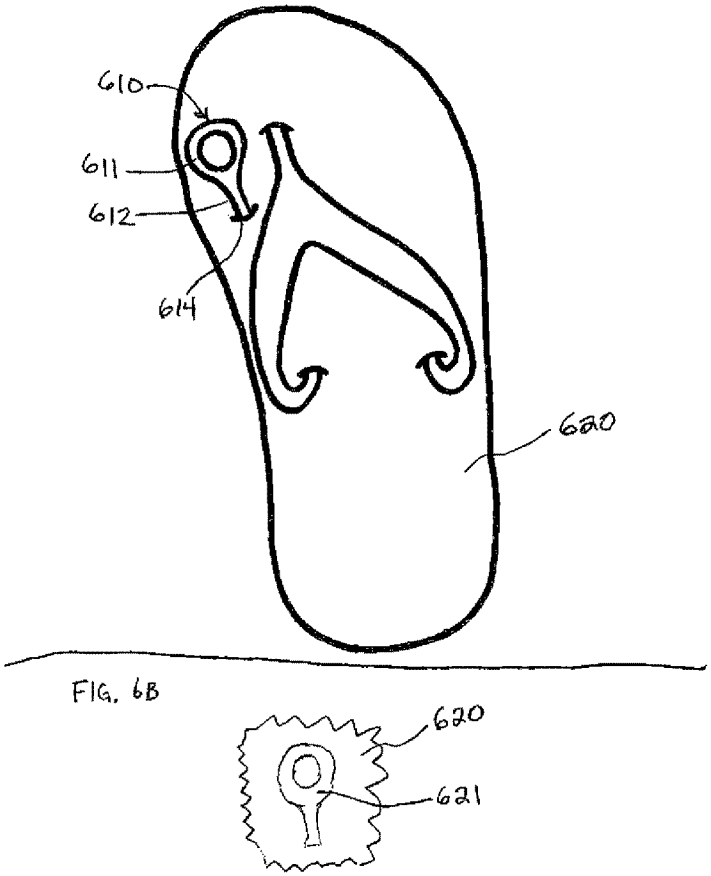
FIG. 6A is a top plan view of a sandal including a toe tether secured to a platform of the sandal in accordance with an embodiment.
FIG. 6B is a closeup top plan view of a recess formed in the platform of FIG. 6A in accordance with an embodiment.

As an alternative to attaching or integrating a toe tether to a retention strap of a sandal, a toe tether may instead be secured to a platform of the sandal. Referring now to FIG. 6A, a sandal including a toe tether secured to a platform of the sandal is depicted. Sandal 600 may include platform 620 and toe tether 610. Toe tether 610 may be secured to platform 620 at attachment point 614. In some embodiments, toe tether 610 may include a self-anchoring region 613 (not depicted) similar to that of region 333 of tether 330 as described with respect to FIG. 3. In these embodiments, tether 610 may be secured to platform 620 in a similar manner as described with respect to tether 330 of FIG. 3. In other embodiments, extension region 612 of tether 610 may be directly integrated with platform 620. For example, tether 610 may be molded with platform 620 as part of the same process used to form platform 620. It is understood that tether 610 may share similar characteristics as described with respect to toe tether 110 of FIGS. 1A and 1B.

Platform 620 may include a recess to accommodate tether 610 when not in use. In this manner, sandal 600 may function as a normal thong sandal when tether 610 is not in use. For example, FIG. 6B shows a cutaway view of recess 621 formed in platform 620. Recess 621 may have substantially the same shape as toe retention region 611 and extension region 612 to allow tether 610 to fit within recess 621. Additionally, recess 621 may be sized slightly smaller than tether 610 in one or more locations to help recess 621 hold tether 610 more securely. In some embodiments, recess 621 may be molded into platform 620 during the same process used to form platform 620. In other embodiments, recess 621 may be formed into platform 620 after platform 620 is formed (e.g., via a cutting process).

Figure 7:
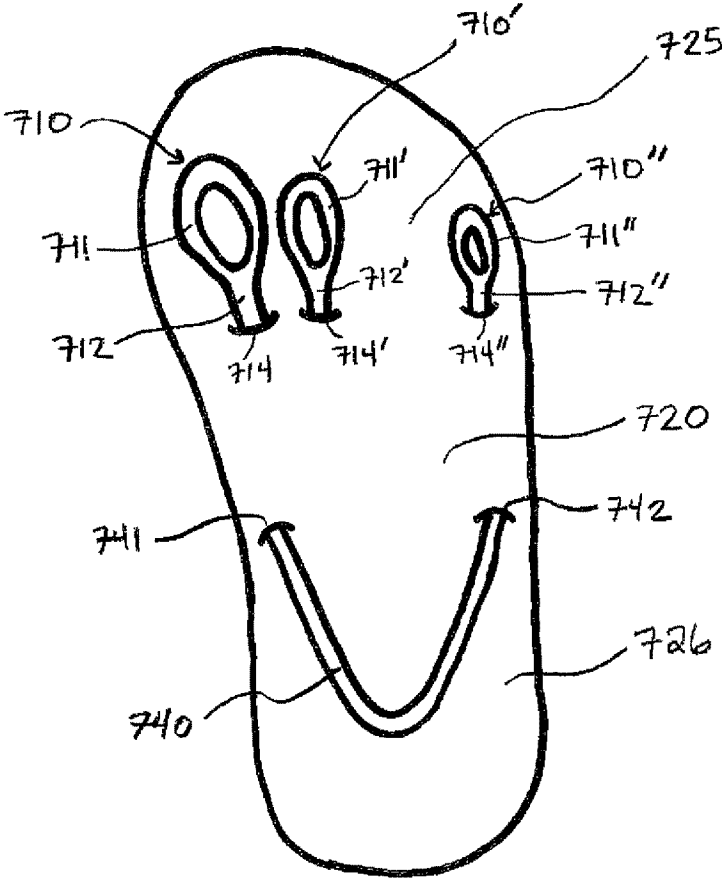
FIG. 7 is a top plan view of a sandal including toe tethers secured to a platform at a toe region of the platform and a heel strap secured to a heel region of the platform in accordance with an embodiment.

In some embodiments, addition of toe tethers to a sandal may preclude the need for a thong-type or other retention strap over the midfoot portion of a foot of the wearer. Referring now to FIG. 7, a sandal including toe tethers secured to a platform at a toe region of the platform and a heel strap secured to a heel region of the platform is depicted. Sandal 700 may include platform 720, heel strap 740, and toe tethers 710, 710', and 710". Platform 720 may include toe region 725. Tethers 710, 710', and 710" may be secured to toe region 725 at attachment points 714, 714', and 714" respectively. In some embodiments, toe tethers 710, 710', and 710" may include a self-anchoring region (not depicted) similar to that of region 333 of tether 330 as described with respect to FIG. 3. In these embodiments, tethers 710, 710', and 710" maybe secured to platform 720 in a similar manner as described with respect to tether 330 of FIG. 3. In other embodiments, extension regions 712, 712', and 712" may be directly integrated with platform 720. For example, tethers 710, 710', and 710" may be molded with platform 720 as part of the same process used to form platform 720. It is understood that tethers 710, 710', and 710" may share similar characteristics as described with respect to toe tether 110 of FIGS. 1A and 1B. Although three toe tethers are depicted in FIG. 7, it is also understood that any suitable number of toe tethers may be included with sandal 700 (i.e., between one and five tethers may be included).

Platform 720 may also include heel region 726. Heel strap 740 may be secured to heel region 726 at attachment points 742 and 742. In some embodiments, heel strap 740 may include self-anchoring regions (not depicted) similar to that of region 333 of tether 330 as described with respect to FIG. 3. In these embodiments, heel strap 740 may be secured to platform 720 in a similar manner as described with respect to tether 330 of FIG. 3. In other embodiments, heel strap 740 may be directly integrated with platform 720. For example, heel strap 740 may be molded with platform 720 as part of the same process used to form platform 720. Heel strap 740 may be constructed from any suitable material, including, but not limited to leather, cloth, and/or rubber.

In another embodiment, the present invention may comprise a method of assembling and/or fitting a sandal having a toe tether, according to the various descriptions herein.

In another embodiment, the present invention may comprise a kit which includes at least a sandal, a toe tether, and a set of instructions for assembling and/or fitting the sandal and toe tether. The sandal and toe tether may comprise any of the embodiments described herein or otherwise encompassed by the present invention. The contents of the kit may be provided in one or more packages, and the instructions may be recorded on a tangible medium or may comprise indications linking a user to electronically accessible instructions. The instructions may comprise, for example, the disclosure recited herein.

In one embodiment, the present invention may comprise a method of providing a sandal to a user, providing a toe tether to the user, and providing a set of instructions to the user for assembling and/or fitting the sandal and toe tether. In another embodiment, the present invention may comprise a method of causing a sandal to be manufactured and made available to a user, causing a toe tether to be manufactured and made available to a user, and providing a set of instructions to the user for assembling and/or fitting the sandal and toe tether. Causing an article to be manufactured and made available to a user may be accomplished by, for example, directing another to manufacture the article Many alterations and modifications of the preferred embodiments will no doubt become apparent to a person of ordinary skill in the art after having read the foregoing description, it is to be understood that the particular embodiments depicted and described by way of illustration are in no way intended to be considered limiting. Thus, references to the details of the described embodiments are not intended to limit their scope. For example, persons of ordinary skill in the relevant art will recognize that the various features described for the different embodiments of the inventions can be suitably combined, un-combined, and re-combined with other features, alone, or in different combinations, within the spirit of the invention. Likewise, the various features described above should all be regarded as example embodiments, rather than limitations to the scope or spirit of the inventions. Therefore, the above is not contemplated to limit the scope of the present inventions.

Persons of ordinary skill in the relevant arts will recognize that the inventions may comprise fewer features than illustrated in any individual embodiment described above. The embodiments described herein are not meant to be an exhaustive presentation of the ways in which the various features of the inventions may be combined. Accordingly, the embodiments are not mutually exclusive combinations of features; rather, the inventions may comprise a combination of different individual features selected from different individual embodiments, as understood by persons of ordinary skill in the art.

For purposes of interpreting the claims for the embodiments of the present inventions, it is expressly intended that the provisions of Section 112, paragraph (f) of 35 U.S.C. are not to be invoked unless the specific terms "means for" or "step for" are recited in a claim.

What is claimed is:

1. A toe tether for use with a sandal, the sandal having a platform and a retention strap that is secured to three locations on the platform, the retention strap including a post region operative to fit between two toes of a human foot, wherein the post region is secured to one of the three locations, the toe tether comprising:

a toe retention region having a first band which defines a first aperture, the toe retention region being constructed to engage a toe of the human foot through the first aperture;

an extension region integrated with and distinct from the first aperture of the toe retention region;

a self anchoring region having a second band which defines a second aperture, the self anchoring region being integrated with the extension region such that the extension region extends between the toe retention region and the self-anchoring region, and the toe retention region, the extension region, and the self anchoring region are made of the same material to form an integrated, unitary toe tether, wherein the toe retention region and the extension region removably wrap around a portion of the retention strap and pass through the second aperture of the self anchoring region so that the toe tether is secured to the portion of the strap, and wherein the extension region has a length sufficient to enable the toe retention region to engage the toe;

a first transition defined between the toe retention region and the extension region;

a second transition defined between the self anchoring region and the extension region, wherein each of the first transition and the second transition are not adjustable; and wherein the thickness of the first band, the second band, and the extension region are generally equal.

2. The toe tether of claim 1, wherein the toe retention region comprises a ring configured to slide over the toe.

3. The toe tether of claim 1, wherein the toe retention region comprises a pouch configured to encapsulate the toe.

4. The toe tether of claim 1, wherein the toe retention region is a first toe retention region, the toe tether further comprising a second toe retention region constructed to engage a second toe.

5. The toe tether of claim 1, wherein the extension region comprises an elastic material.

6. The toe tether of claim 1, wherein the self anchoring region comprises an opening large enough to permit passage of the toe retention region and at least a portion of the extension region through the opening.

7. The toe tether of claim 1, wherein the portion of the retention strap is located between the post region and one of the other three locations.

8. The toe tether of claim 1, wherein the portion of the retention strap is located on the post region.

9. The toe tether of claim 1, wherein the self-anchoring region comprises a wedge-shaped barb configured to fit against a top side of the platform and a lip configured to fit against a bottom side of the platform.

10. A sandal comprising:

a platform;

a retention strap that is secured to three locations on the platform, the retention strap including a post region operative to fit between two toes of a human foot, wherein the post region is secured to one of the three locations; and a toe tether, including:

a toe retention region having a first band which defines a first aperture, the toe retention region being constructed to engage a toe of the human foot through the first aperture;

an extension region integrated with and distinct from the first aperture of the toe retention region;

a self anchoring region having a second band which defines a second aperture, the self anchoring region being integrated with the extension region such that the extension region extends between the toe retention region and the self-anchoring region, and the toe retention region, the extension region, and the self anchoring region are made of the same material to form an integrated, unitary toe tether, wherein the toe retention region and the extension region removably wrap around a portion of the retention strap and pass through the second aperture of the self anchoring region so that the toe tether is secured to the portion of the strap, and wherein the extension region has a length sufficient to enable the toe retention region to engage the toe;

a first transition defined between the toe retention region and the extension region;

a second transition defined between the self anchoring region and the extension region, wherein each of the first transition and the second transition are not adjustable; and wherein the thickness of the first band, the second band, and the extension region are generally equal.

11. The sandal of claim 10, wherein the toe retention region comprises a ring configured to slide over the toe.

12. The sandal of claim 10, wherein the toe retention region comprises a pouch configured to encapsulate the toe.

13. The sandal of claim 10, wherein the toe retention region is a first toe retention region, the toe tether further comprising a second toe retention region constructed to engage a second toe.

14. The sandal of claim 10, wherein the extension region comprises an elastic material.

15. The sandal of claim 10, wherein the self anchoring region comprises an opening large enough to permit passage of the toe retention region and at least a portion of the extension region through the opening.

16. The sandal of claim 10, wherein the portion of the retention strap is located between the post region and one of the other three locations.

17. The sandal of claim 10, wherein the portion of the retention strap is located on the post region.

18. The sandal of claim 10, wherein the self-anchoring region comprises a wedge-shaped barb configured to fit against a top side of the platform and a lip configured to fit against a bottom side of the platform.

* * * * *